US005881805A

United States Patent [19]

Inoue et al.

[11] Patent Number: 5,881,805

[45] Date of Patent: Mar. 16, 1999

[54] LAMINATED HEAT EXCHANGER

[75] Inventors: Seiji Inoue; Kunihiko Nishishita, both of Konan; Fumio Ohkubo, Higashimatsuyama, all of Japan

[73] Assignee: Zexel Corporation, Tokyo, Japan

[21] Appl. No.: 24,131

[22] Filed: Feb. 17, 1998

[30] Foreign Application Priority Data

Feb. 21, 1997 [JP] Japan ..... 9-053848
Dec. 26, 1997 [JP] Japan ..... 9-369475

[51] Int. Cl.[6] ..... F28D 1/03

[52] U.S. Cl. ..... 165/153; 165/176

[58] Field of Search ..... 165/153, 176; 62/515

[56] References Cited

U.S. PATENT DOCUMENTS

| | | | |
|---|---|---|---|
| 3,153,447 | 10/1964 | Yoder et al. | 165/170 X |
| 3,650,321 | 3/1972 | Kaltz | 165/178 X |
| 4,081,025 | 3/1978 | Donaldson | 165/153 X |
| 4,775,006 | 10/1988 | Hesse | 165/176 X |
| 5,211,222 | 5/1993 | Shinmura | 165/176 |
| 5,252,778 | 10/1993 | Ogawa | 165/153 X |
| 5,620,047 | 4/1997 | Nishishita | 165/153 |

FOREIGN PATENT DOCUMENTS

| | | | |
|---|---|---|---|
| 203798 | 7/1992 | Japan | 165/176 |
| 106937 | 4/1993 | Japan | 62/515 |

*Primary Examiner*—Leonard R. Leo
*Attorney, Agent, or Firm*—Wenderoth, Lind & Ponack, L.L.P.

[57] ABSTRACT

In a laminated heat exchanger constituted by using tube elements each having a heat exchanging medium passage and tanks formed as an integrated unit, the wall surfaces between a plurality of shoal-like beads formed in heat exchanging medium passage of the tube element at the boundary between the heat exchanging medium passage and the tank and between the shoal-like beads and the side edges of the tube element are made to incline to gradually widen in the direction of the lamination as they approach the tanks. With this, the flow area at the boundary between the heat exchanging medium passage and the tank is increased compared to that in a tube element in the prior art, and moreover, since the angle at which heat exchanging medium flows from the tanks into heat exchanging medium passage is wider, the resistance that heat exchanging medium is subject to when it flows from the tanks into heat exchanging medium passage becomes reduced. This results in the heat exchanging medium flowing in sufficient quantity in all areas from the tanks into heat exchanging medium passages, thereby achieving a higher degree of consistency in the distribution of the heat exchanging medium.

9 Claims, 13 Drawing Sheets

LAMINATED HEAT EXCHANGER

BACKGROUND OF THE INVENTION

The present invention relates to a laminated heat exchanger which may be employed as an evaporator, an oil cooler or the like in an air conditioning system for vehicles, and more specifically, it relates to a laminated heat exchanger that employs tube elements each having tanks and a heat exchanging medium passage formed as an integrated unit.

A laminated heat exchanger proposed by the applicant of the present invention, which is constituted by laminating over a plurality of levels tube elements each having a pair of tanks and a heat exchanging medium passage communicating between the tanks formed as an integrated unit is disclosed in Japanese Unexamined Patent Publication No. H 4-356690.

To explain the structure of the main tube elements that may constitute this heat exchanger in reference to FIG. 13, a tube element 100 is provided with a pair of tanks 101 and 101 and a U-shaped heat exchanging medium passage 102 communicating between the tanks 101, with communicating holes 103 for communicating with adjacent tanks 101 formed at the two sides of the tanks 101. In each of formed plates 104 that constitute the tube elements 100, as shown in FIG. 14, two bowl-like distended portions for tank formation 105 and 105 are formed at one end in its lengthwise direction and a distended portion for passage formation 106 is formed continuous thereto, although the distended portion for passage formation 106 is only partially shown in the figure. A projection 107 extends out from the area between the two distended portions for tank formation 105 and 105 toward the distended portion for passage formation 106. Although not shown in the figure, the projection 107 extends to the vicinity of the other end of the formed plate 104. In addition, an indented portion 108 for mounting a communicating pipe (not shown) is provided between the two distended portions for tank formation 105 and 105. In the distended portion for passage formation 106, a plurality of shoal-like beads 109 are formed as extended protuberances near the distended portions for tank formation 105 and 105.

Thus, when such tube elements 100 are laminated over a plurality of levels with corrugated fins 111 provided in between them, the direction in which the heat exchanging medium passage 102 communicating between a pair of tanks 101 and 101 in each tube element 100 and the direction that the heat exchanging medium takes when flowing through the tanks 101 and the communicating holes 103 of adjacent tube elements 100, i.e., the direction of the lamination of the tube elements 100, are perpendicular to each other.

However, in the heat exchanger disclosed in the publication mentioned above, the heat exchanging medium passage 102 maintains an almost consistent flow area from the side opposite from the tanks through the side where the tanks 101 are provided. In other words, since the heat exchanging medium passage 102 is formed linearly, wall surfaces 110 at the two sides of the shoal-like beads 109 located near the tanks 101 in the heat exchanging medium passage 102 are continuous to and in contact with the walls at the tanks 101 toward heat exchanging medium side approximately at a right angle. In addition, the flow area of the heat exchanging medium passage 102 at the point where it communicates with the tank 101 is normally smaller than the opening area of the communicating holes 103 that communicate between the tanks in tank groups, since, at that point, the heat exchanging medium flows past the two sides of the shoal-like beads.

Because of this, when a portion of the heat exchanging medium flowing through the tanks 101 in the direction of the lamination via the communicating holes 103 flows into the heat exchanging medium passages 102, the heat exchanging medium must make a right-angle turn, as indicated by the arrow in FIG. 13. Moreover, since the flow area of the heat exchanging medium passage 102 at the boundary between the heat exchanging medium passage and the tanks 101 is considerably smaller than the opening area of the communicating holes 103 at the tanks 101, the heat exchanging medium encounters a large resistance when it flows into the heat exchanging medium passages 102 from the tanks 101. Consequently, at locations where the heat exchanging medium flows at high speed, in particular, heat exchanging medium does not readily flow into the heat exchanging medium passages 102 from the tanks 101 due to the increased resistance, resulting in inconsistency in the distribution of the heat exchange which, in turn, leads to a concern that the heat exchanger does not perform to its full capacity.

SUMMARY OF THE INVENTION

Accordingly, an object of the present invention is to provide a laminated heat exchanger that achieves an improvement in the performance of the heat exchanger by reducing the resistance that the heat exchanging medium is subject to when it flows into the heat exchanging medium passages from the tanks to ensure that the heat exchanging medium can smoothly flow from the tanks into the heat exchanging medium passages.

Thus, in the laminated heat exchanger according to the present invention, which is constituted by laminating tube elements each having a pair of tanks, communicating holes formed in the direction of the lamination and a heat exchanging medium passage communicating between the tanks, all formed as an integrated unit, with a plurality of shoal-like beads continuous to the tanks formed at positions in the heat exchanging medium passage where it communicates with the tanks, over a plurality of levels with corrugated fins provided in between, wall surfaces between the shoal-like beads or between the shoal-like beads and the side edges of the tube element in the heat exchanging medium passage in each of the tube elements, are made to incline so that they gradually widen in the direction of the lamination as they approach the tanks.

With this, since the flow area of the heat exchanging medium passage at the positions where it communicates with the tanks is increased compared to that in a tube element in the prior art and the inflow angle at which the heat exchanging medium changes its direction from the direction of the lamination in which it flows through a tank group into the heat exchanging medium passages is made wider with the wall surfaces in the heat exchanging medium passage between the shoal-like beads or between shoal-like beads and the side edge of the tube element formed as inclined surfaces, the resistance that the heat exchanging medium is subject to when it flows from the tanks into the heat exchanging medium passages is reduced, thereby facilitating smooth flow of the heat exchanging medium from the tanks into the heat exchanging medium passages.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENT

The following is an explanation of a preferred embodiment of the present invention in reference to the drawings.

In FIGS. 1 through 6, an example of a laminated heat exchanger which may be employed as an evaporator or an oil cooler in an air conditioning system for vehicles is shown.

Figure 1:
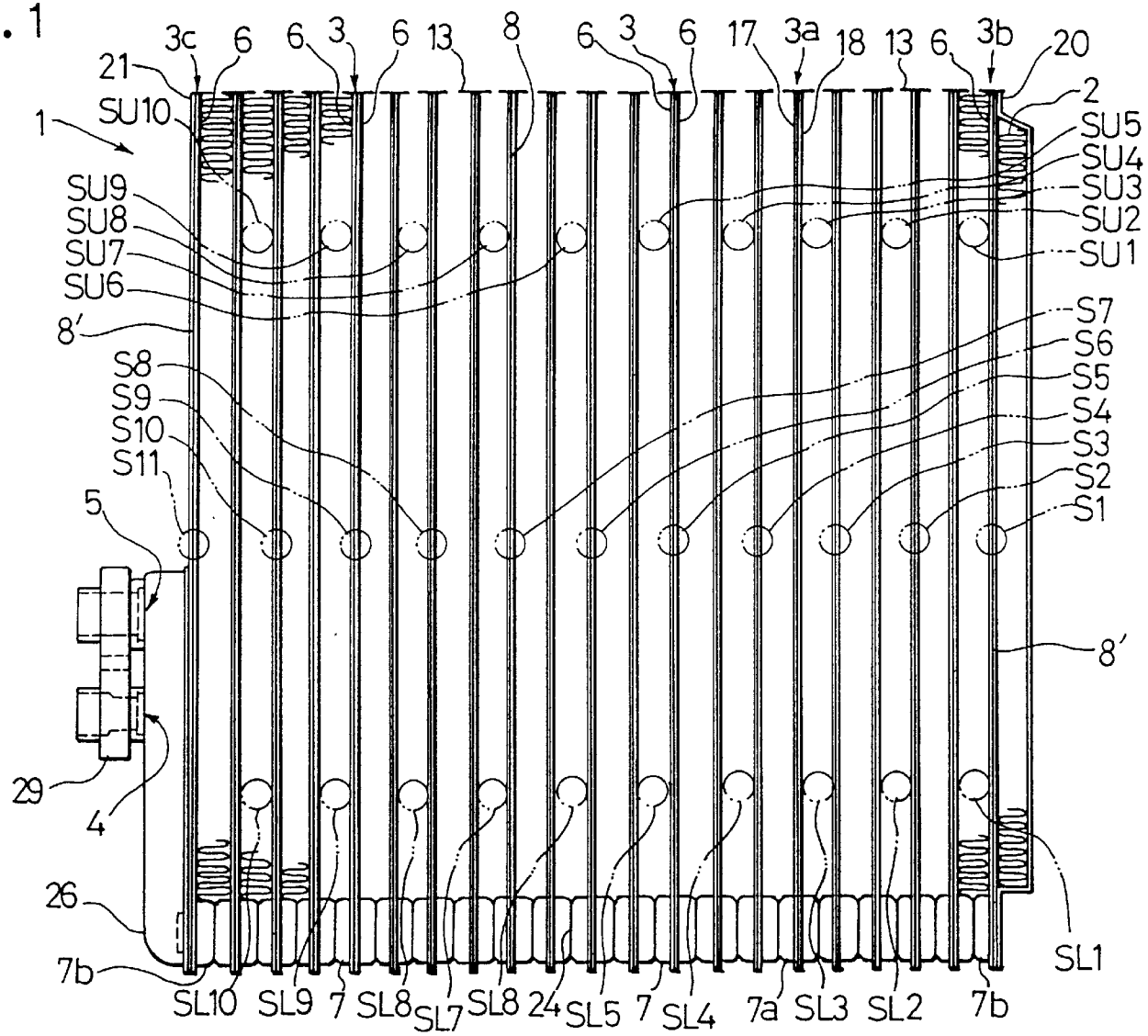
FIG. 1 is a front view illustrating a structural example of the laminating heat exchanger according to the present invention.
Figure 2A:
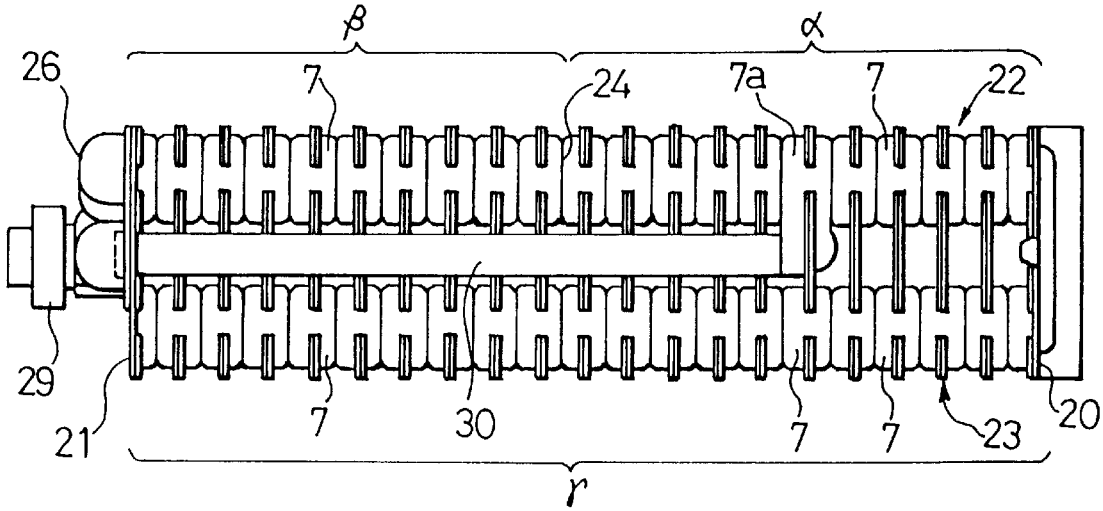
FIG. 2A is a bottom view of the laminated heat exchanger above viewed from below and FIG. 2B is a side elevation of the laminated heat exchanger above viewed from the side.
Figure 2B:
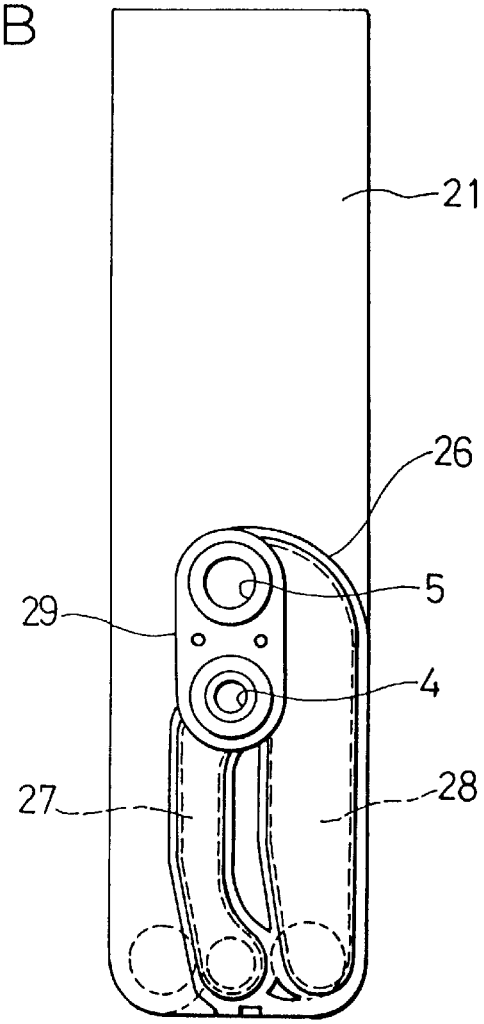

In this laminated heat exchanger 1, which is a unilateral tank type heat exchanger with tanks located at, for instance, the lower side, and employs a four pass system, as shown in FIGS. 1, 2A and 2B, with its core main body formed by alternately laminating corrugated fins 2 and tube elements 3, 3*a*, 3*b* and 3*c* as appropriate over a plurality of levels and an inflow portion 4 and an outflow portion 5 for a heat exchanging medium (a coolant, for instance) provided at one end in the direction of the lamination, each of the tube elements 3 is formed by bonding face-to-face formed plates 6 and 6 at their peripheral edges and is provided with a pair of tanks 7 and 7 at one side and a heat exchanging medium passage 8 through which heat exchanging medium passes from the tanks 7 to the other end.

Figure 3A:
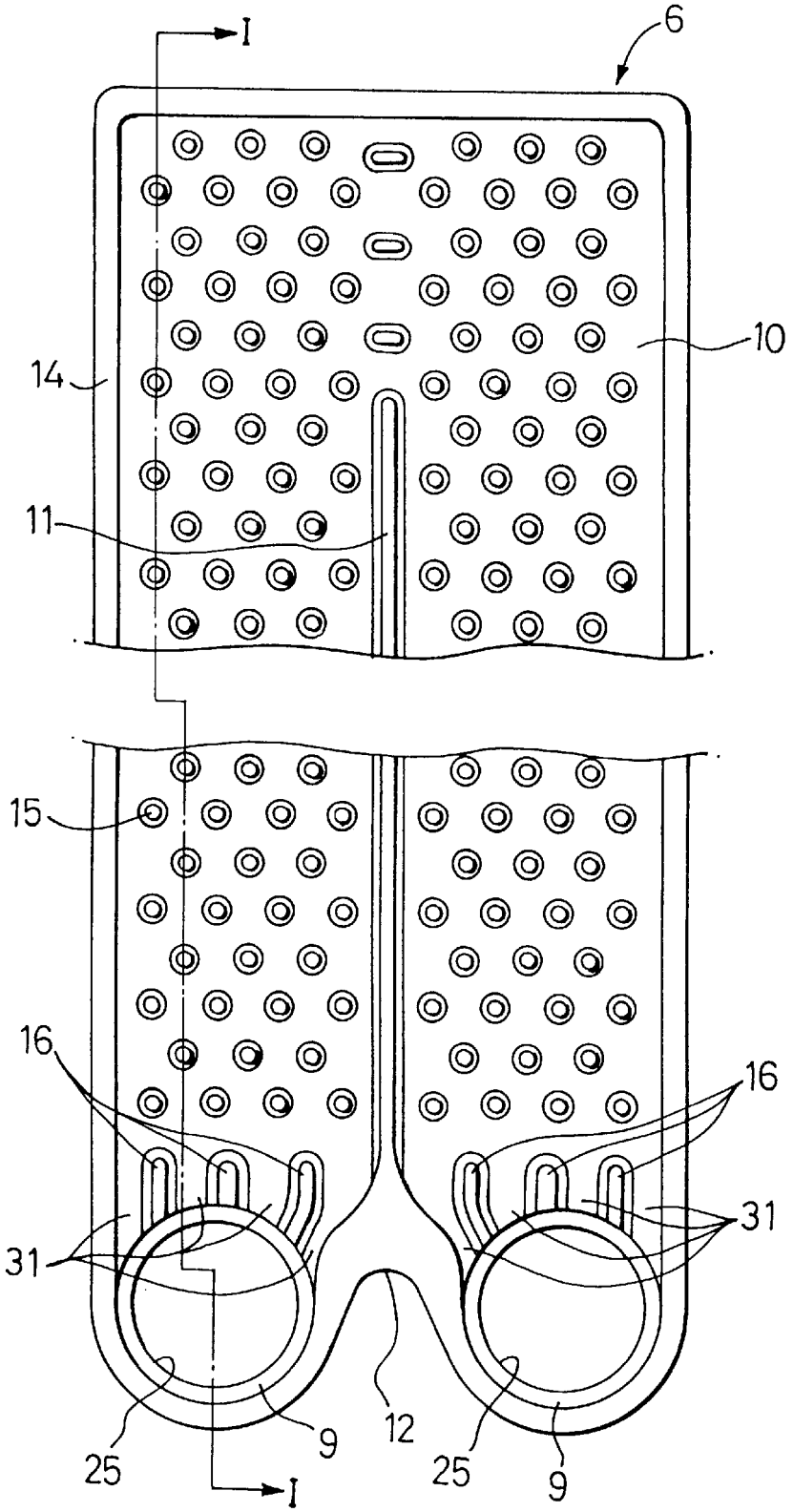
FIG. 3 illustrates one of the formed plates used to constitute the tube elements that are the main component of the laminated heat exchanger above, with FIG. 3A presenting its front view and FIG. 3B presenting a cross section through line I—I in FIG. 3A.
Figure 3B:
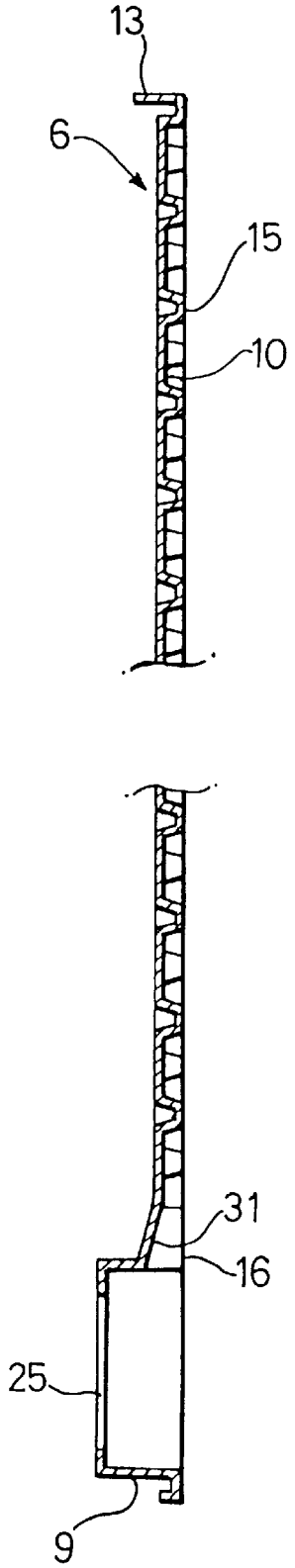

Each of the formed plates 6 is formed by press machining an aluminum alloy whose main constituent is aluminum clad with a brazing material at both surfaces and, as shown in FIGS. 3A and 3B, it is provided with two bowl-like distended portions for tank formation 9 and 9 at one end and a distended portion for passage formation 10 formed continuous to them. A projection 11 is formed at the distended portion for passage formation 10, extending from the area between the two distended portions for tank formation 9 and 9 to the vicinity of the other end of the formed plate 6. In addition, an indented portion 12 for mounting a communicating pipe, which is to be detailed later, is provided between the two distended portions for tank formation 9 and 9 and a projecting piece 13 is provided at the other end of the formed plate 6 to prevent the fins 2 from falling out during assembly prior to brazing.

The distended portions for tank formation 9 distend to a larger degree than the distended portion for passage formation 10. In addition, the projection 11 is formed to lie on the same plane as a bonding margin 14 at the peripheral edges of the formed plate. When two formed plates 6 and 6 are bonded to each other at their peripheral edges, their projections 11, too, become bonded to each other so that a pair of tanks 7 and 7 are constituted with the distended portions for tank formation 9 that face opposite each other and a U-shaped heat exchanging medium passage 8 connecting between the tanks 7 and 7 is constituted with the distended portions for passage formation 10 that face opposite each other.

In addition, a number of beads 15 are formed at the distended portion for passage formation 10 during press machining to improve the heat exchanging efficiency, and each of the beads 15 becomes bonded to the corresponding bead 15 formed at the position that faces opposite it when two formed plates 6 and 6 are bonded to each other. While the beads 15 illustrated in FIGS. 3A and 3B are basically round, their shape is arbitrary and they may be formed in an oval shape, a polygonal shape or any other shape. Moreover, where the distended portions for tank formation 9 and the distended portion for passage formation 10 meet, a plurality of shoal-like beads 16 are formed as extended protuberances to achieve a structure that facilitates the flow of the heat exchanging medium from the tanks 7 past the two sides of each shoal-like bead 16 into the heat exchanging medium passage 8.

Figure 4A:
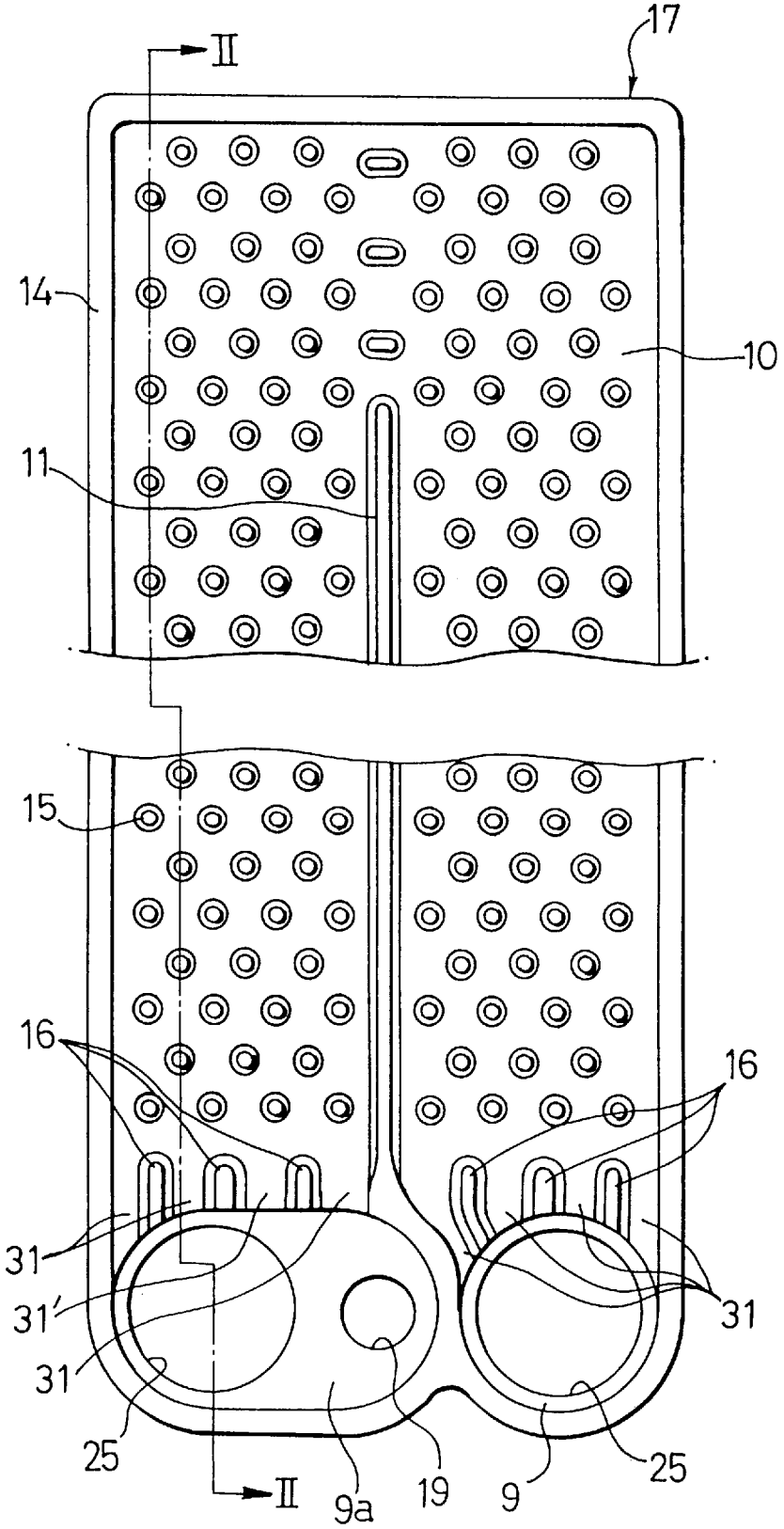
FIG. 4 illustrates one of the formed plates constituting the tube element provided with an extended tank employed in the laminated heat exchanger shown in FIG. 1, with FIG. 4A presenting its front view and FIG. 4B presenting a cross section through line II—II in FIG. 4A.
Figure 4B:
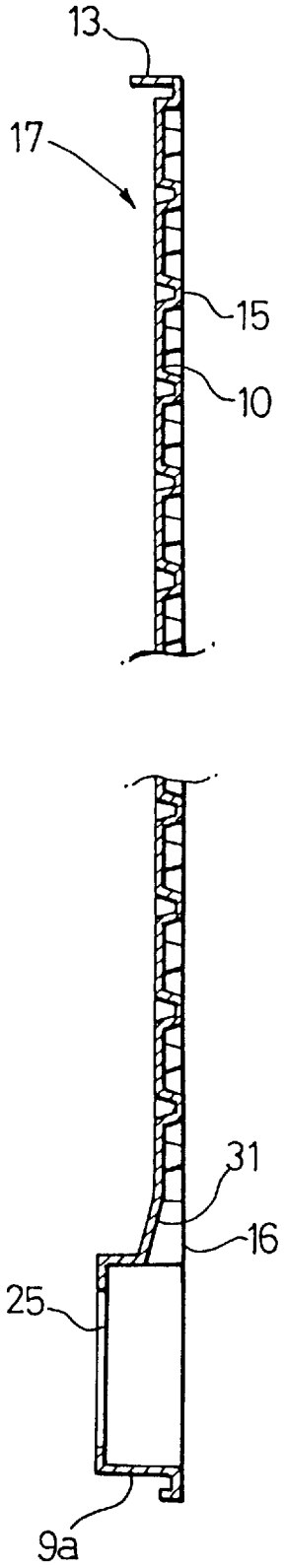
Figure 5A:
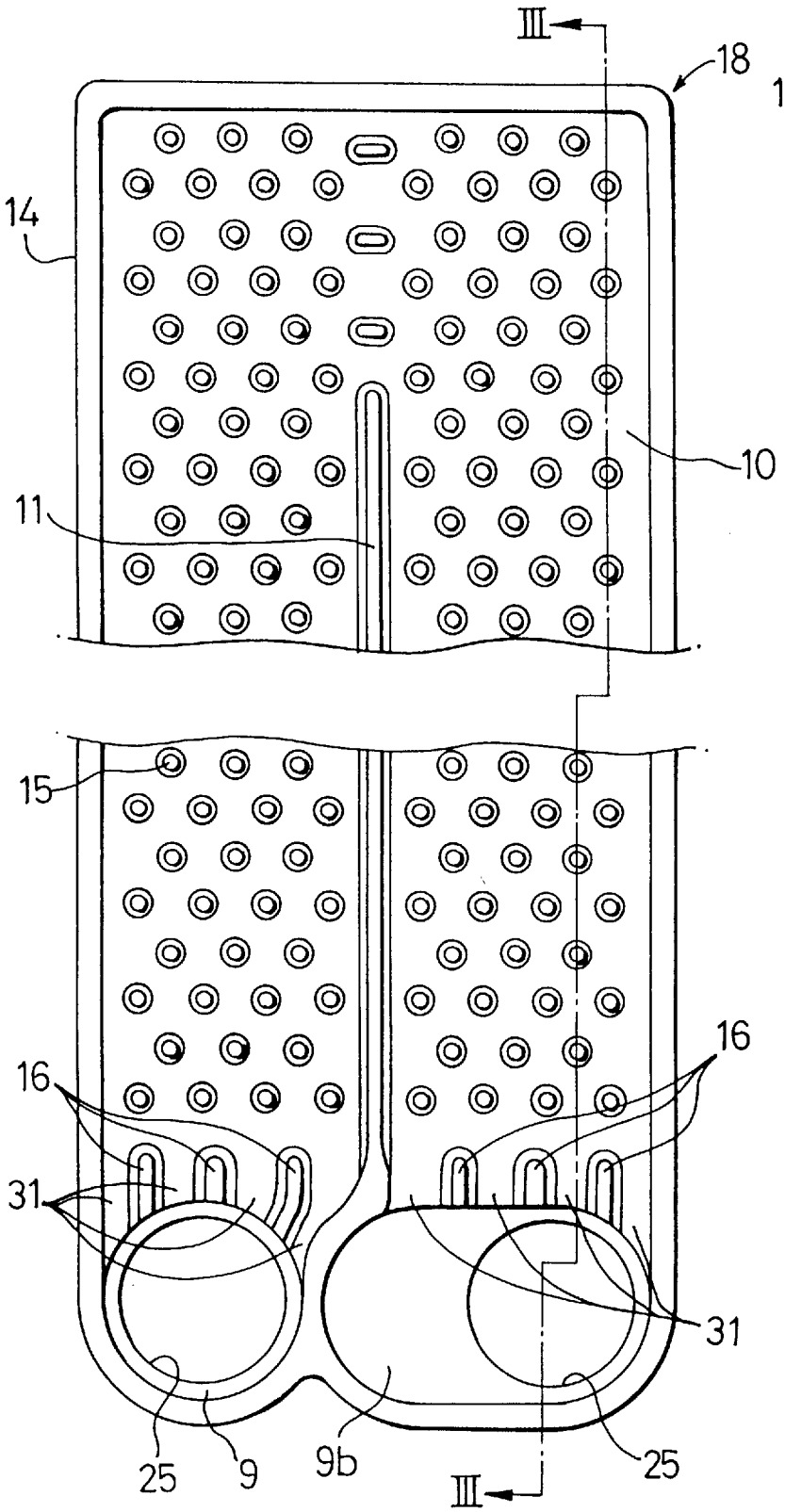
FIG. 5 illustrates the other formed plate that, together with the formed plate shown in FIG. 4, constitutes the tube element provided with an extended tank employed in the laminated heat exchanger shown in FIG. 1, with FIG. 5A presenting its front view and FIG. 5B presenting a cross section through line III—III in FIG. 5A.
Figure 5B:
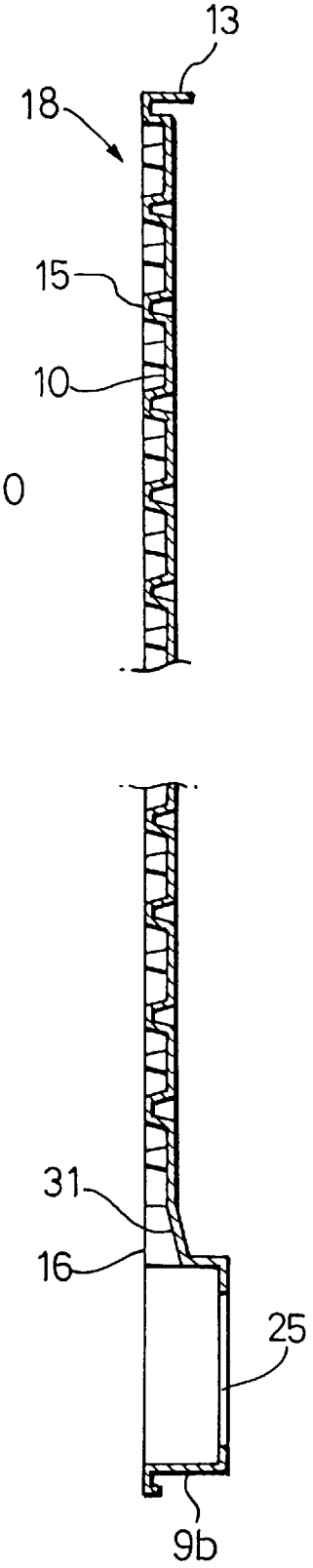

In addition, the tube element 3*a* located at a specific position closer to one side from the center is not provided with the indented portion 12, with one of its tanks, i.e., a tank 7*a* formed to extend so as to lie in close proximity to the other tank 7 and is constituted by bonding face-to-face the formed plate 17 illustrated in FIGS. 4A and 4B with the formed plate 18 shown in FIGS. 5A and 5B.

In the formed plate 17, one distended portion for tank formation 9*a* in its pair of distended portions for tank formation 9 and 9*a* is extended in the direction of the airflow and a hole 19 into which the communicating pipe, which is to be detailed later, is to be connected, is formed at the distended portion for tank formation 9*a*. In the formed plate 18, one distended portion for tank formation 9*b* in its pair of distended portions for tank formation 9 and 9*b*, which is to be bonded with the distended portion for tank formation 9*a* is extended in the direction of the airflow. Where the distended portions for tank formation 9 and 9*a* and the distended portions for tank formation 9 and 9*b* meet the heat exchanging medium passage 8 in the formed plate 17 and 18, a plurality of shoal-like beads 16 are formed. It is to be noted that since other structural features of the formed plates 17 and 18 are identical to those of the formed plate 6, the same reference numbers are assigned to them and their explanation is omitted.

Figure 6:
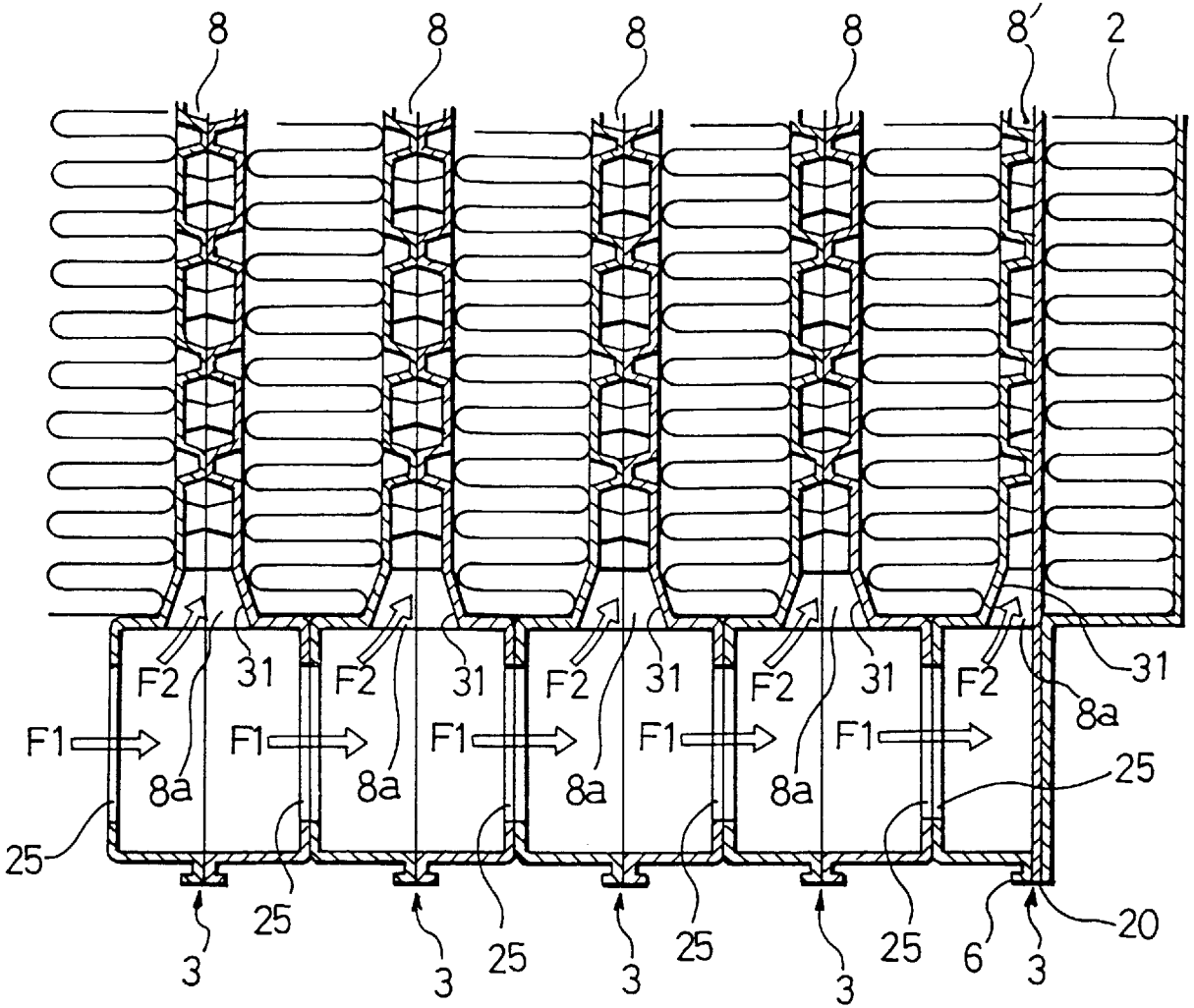
FIG. 6 is a cross section illustrating a state in which the heat exchanging medium flows into heat exchanging medium passages from tanks in the heat exchanger above.

In addition, the tube element 3*b*, which is positioned at the end in the direction of the lamination at the side away from the inflow portion 4 and the outflow portion 5, is constituted by bonding a flat plate 20 with no distended portions to the formed plate 6 shown in FIGS. 3A and 3B, whereas the tube element 3*c* at the other end in the direction of the lamination closer to the inflow portion 4 and the outflow portion 5 is constituted by bonding a flat plate 21 with no distended portions which has communicating holes (not shown) for communicating with an inflow passage and an outflow passage to be detailed later, to the formed plate 6 shown in FIGS. 3A and 3B. Thus, as shown in FIGS. 1 and 6, the tube elements 3*b* and 3*c* are each provided with a tank 7*b* and a heat exchanging medium passage 8' whose overall capacity is approximately half that of the tube element 3.

Adjacent tube elements 3 are abutted at the distended portions for tank formation 9 at their respective formed plates 6, and the tube element 3*a*, too, is abutted at the distended portions for tank formation 9 and 9*a* and the distended portions for tank formation 9 and 9*b* with the distended portions for tank formation 9 of the adjacent tube elements 3 in a manner similar to that in which the tube element 3 are abutted with each other, although in the tube element 3*a*, the formed plates 17 and 18, which are structured differently from the formed plate 6, are used. In addition, the tube elements 3*b* and 3*c* are abutted at their distended portions for tank formation 9 with the distended portions for tank formation 9 of the adjacent tube elements 3 at the sides where the formed plates 6 are located in the tube elements 3*b* and 3*c*. With this, two tank groups 22 and 23 that extend in the direction of the lamination (perpendicular to the direction of the airflow) are formed, and in one of the tank groups, i.e., in the tank group 22 that includes the extended tank 7*a*, the individual tanks are in communication with each other through the communicating holes 25 formed at the distended portions for tank formation 9, 9*a* and 9*b* except at a partitioning portion 24, which is located at approximately the center in the direction of the lamination, whereas in the other tank group 23, all the tanks are in communication via the communicating holes 25 with no partitioning.

In this embodiment, a total of 21 tube elements 3, 3*a*, 3*b* and 3*c* are laminated as appropriate, with the tube element 3*a* having the extended tank 7*a* being the sixteenth tube element counting from the end where the inflow portion 4 and the outflow portion 5, which are to be detailed below, are formed and the partitioning portion 24 provided at the area where the tenth and eleventh tube elements 3 counting from the end where the inflow portion 4 and the outflow portion 5 are formed, are bonded to each other. In this structure, the partitioning portion 24 may be constituted by not forming a communicating hole at one or both of the formed plates to be bonded together or it may be constituted by using formed plates identical to the rest of the formed plates 6 and simply blocking the communicating holes 25 with a blind plate when bonding them.

Thus, as shown in FIG. 2A, the tank group 22 is divided into a first tank block α that includes the extended tank 7*a* and a second tank block β located between the outflow portion 5 and the first tank block α by the partitioning portion 24, whereas the unpartitioned tank group 23 itself constitutes a third tank block γ with its twenty-one tanks 7 in communication with each other.

The inflow portion 4 and the outflow portion 5, which are provided at the end away from the extended tank 7*a*, are constituted by bonding a distribution plate 26 to the flat plate 21 from the outside, forming an inflow passage 27 and an outflow passage 28 extending from the middle of the tube element 3*c* in the lengthwise direction toward the tanks and providing a connecting portion 29 at the distribution plate 26 for connecting a block type expansion valve (not shown).

The inflow passage 27 and the extended tank 7*a* are connected in such a manner that they can communicate with each other through a communicating pipe 30 fitted in the indented portions 12 of the tube elements 3 located between them, and the second tank block β and the outflow passage 28 at its side are made to communicate with each other through a communicating hole formed at the flat plate 21.

Thus, the heat exchanging medium that has flowed in through the inflow portion 4 travels through the inflow passage 27 and the communicating pipe 30 to enter the extended tank 7*a* and becomes dispersed throughout the entirety of the portion of the tank group 22 that constitutes the first tank block α. Then it flows upward along the projections 11 through the heat exchanging medium passages 8 of the tube elements corresponding to this portion of the tank group 22. After this, it makes a U-turn at the top of the projections 11 to travel downward and reaches the tank group 23 constituting the third tank block theta at the opposite side. After this, it travels upward from the remaining tanks 7 constituting the tank group 23 through the heat exchanging medium passages 8 of the tube elements along the projections 11. Then it makes a U-turn at the top of the projections 11 to travel downward to be led into the portion of the tank group 22 that constitutes the second tank block β before it travels through the outflow passage 28 to flow out through the outflow portion 5. Thus, the heat carried in the heat exchanging medium is communicated to the fins 2 during the process in which the heat exchanging medium flows through the heat exchanging medium passages 8 so that heat exchange can be effected with the air passing between the fins 2 and 2.

Now, as particularly illustrated in FIG. 3B, in the formed plate 6, each of the wall surfaces 31 in the portions between the shoal-like beads 16 and in the portions between the shoal-like beads 16 and the peripheral edges in the distended portion for passage formation 10, inclines in the direction in which it gradually moves away from the side at which the formed plate 6 is bonded with the formed plate that faces opposite in the direction of the lamination as it approaches the tanks 7. Because of this, the tube element 3 which is constituted by bonding face-to-face such formed plates 6 achieves a so-called tapered shape at the portion 8*a* that is in close proximity to the tanks 7 in the heat exchanging medium passage 8 whereby its flow area gradually increases at both sides in the direction of the lamination as it approaches the tank side, as illustrated in FIG. 6.

Thus, as shown in FIG. 6, the angle of the flow direction F2 of the heat exchanging medium traveling upward from the tanks 7 toward the heat exchanging medium passages 8 relative to the flow direction F1 of the heat exchanging medium flowing horizontally between the adjacent tanks 7 and 7 via the communicating holes 25 becomes wider than approximately 90°, with the individual wall surfaces 31 formed in the portions between the shoal-like beads 16 and in the portions between the shoal-like beads 16 and the peripheral edges inclining to widen in the direction of the lamination as explained above. In addition, the cross sections, i.e., the flow areas, in the heat exchanging medium passages 8 near the tanks 7 increases. Moreover, in the tube elements 3*b* and 3*c*, each constituted by a formed plate 6 at one side thereof, too, the wall surfaces 31 in the portions between the shoal-like beads 16 and in the portions between the shoal-like beads 16 and the peripheral edges incline at least toward the formed plates 6, and in proportion to this inclination, the resistance can be reduced when the heat exchanging medium flows into the heat exchanging medium passages 8' from the tank 7*b*.

Furthermore, in the tube element 3*a*, which is constituted by employing the formed plates 17 and 18, which are different from the formed plate 6, in order to form the extended tank 7*a*, the wall surfaces 31 in the portions between the shoal-like beads 16 and 16 and in the portions between the shoal-like beads 16 and the peripheral edges in these formed plates 17 and 18 incline as illustrated in FIGS. 4B and 5B, thereby achieving a reduction in the resistance that the heat exchanging medium is subject to when it flows into the heat exchanging medium passages 8 as in the case of tube elements 3.

Consequently, the resistance that the heat exchanging medium is subject to when it flows into the heat exchanging medium passages 8 from the tanks 7 and 7*a* is greatly reduced, thereby achieving greater consistency in the heat exchange distribution compared to that achieved in the prior art. This is demonstrated in the characteristics diagrams presented in FIGS. 7 through 12, which are described in detail below.

Figure 7:
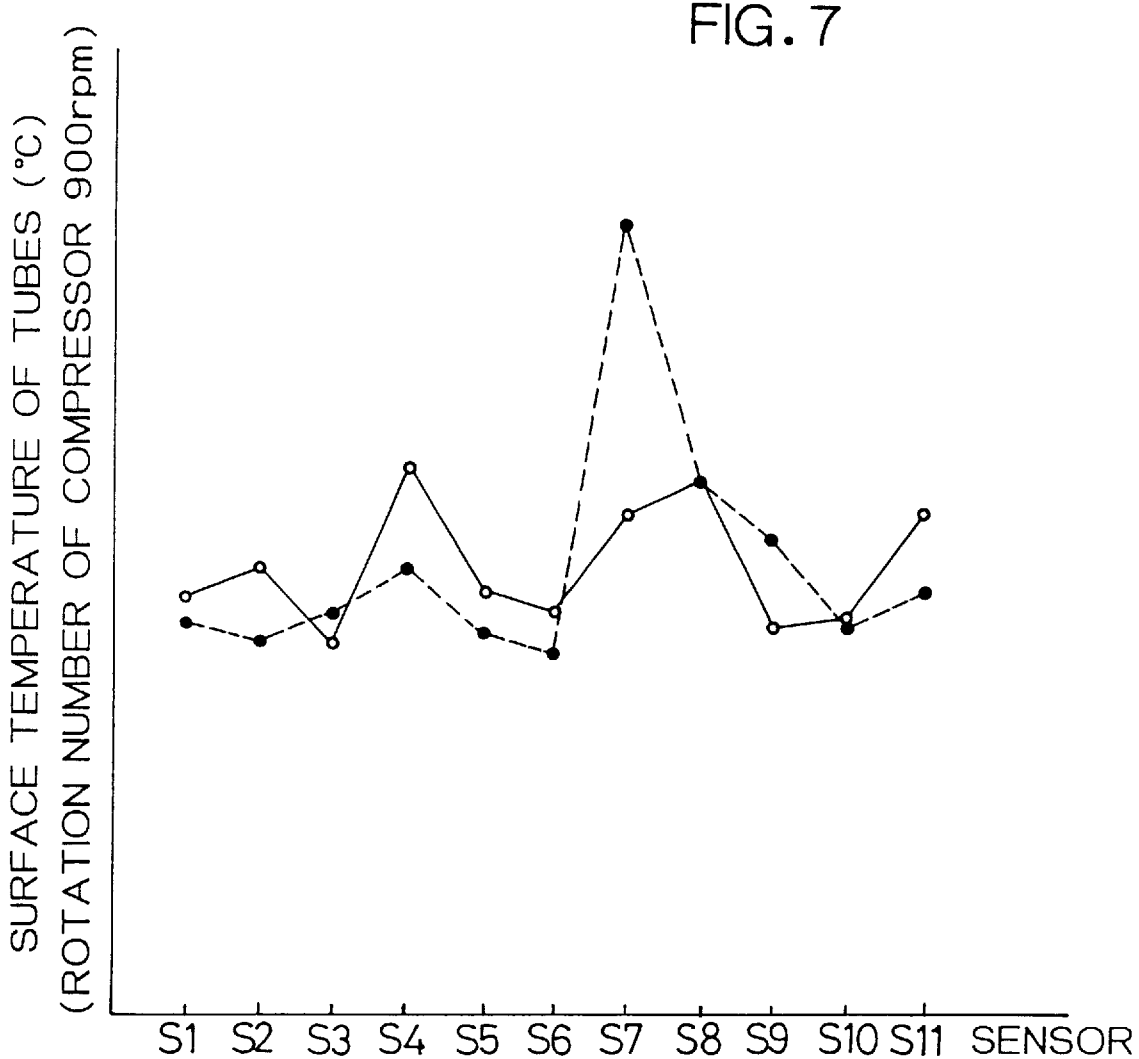
FIG. 7 is a characteristics diagram presenting the surface temperatures at the tube elements measured with the compressor rotation rate at 900 rpm in the heat exchanger above and a heat exchanger in the prior art respectively indicated by the solid line and the broken line.

The characteristics diagram presented in FIG. 7 indicates the distribution of tube element surface temperatures measured by employing tube elements in which the wall surfaces in the portions between the shoal-like beads and in the portions between the shoal-like beads and the peripheral edges are made to incline so that their flow areas gradually increase toward both sides in the direction of the lamination (hereafter referred to as the new type of tube elements) with the solid line and indicates the distribution of tube element surface temperatures measured by using tube elements in which the wall surfaces in the portions between the shoal-like beads and in the portions between the shoal-like beads and the peripheral edges extend perpendicular to the direction of the lamination of the tanks (hereafter referred to as the old type of tube elements) with the broken line. The temperatures were measured with the rotation rate of the compressor set at 900 rpm and the air quantity for the laminated heat exchanger set at 420m$^3$ per hour. In addition, the characteristics diagram presented in FIG. 8 indicates the distribution of tube element surface temperatures measured by employing the new type of tube elements with the solid line and indicates the distribution of the tube element surface temperatures measured by using the old type of tube elements with the broken line, with the temperatures measured with the rotation rate of the compressor set at 1800 rpm and the air quantity for the laminated heat exchanger set at 420m$^3$ per hour.

The surface temperatures at both of the laminated heat exchangers were measured by 11 temperature sensors S1 through S11 located at positions approximately 106 mm down from the end portion having the projecting pieces 13. The specific positions of these temperature sensors are explained in reference to FIG. 1. The temperature sensor S1 is provided on the tube element 3*b*, the temperature sensor S2 is provided on the third tube element 3 counting from the tube element 3*b*, the temperature sensor S3 is provided on the fifth tube element 3 counting from the tube element 3*b*, the temperature sensor S4 is provided on the seventh tube element 3 counting from the tube element 3*b*, the temperature sensor S5 is provided on the ninth tube element 3 counting from the tube element 3*b*, the temperature sensor S6 is provided on the eleventh tube element 3 counting from the tube element 3*b*, the temperature sensor S7 is provided on the ninth tube element 3 counting from the tube element 3*c*, the temperature sensor S8 is provided on the seventh tube element 3 counting from the tube element 3*c*, the temperature sensor S9 is provided on the fifth tube element 3 counting from the tube element 3*c*, the temperature sensor S10 is provided on the third tube element 3 counting from the tube element 3*c* and the temperature sensor S11 is provided on the tube element 3*c*.

Figure 8:
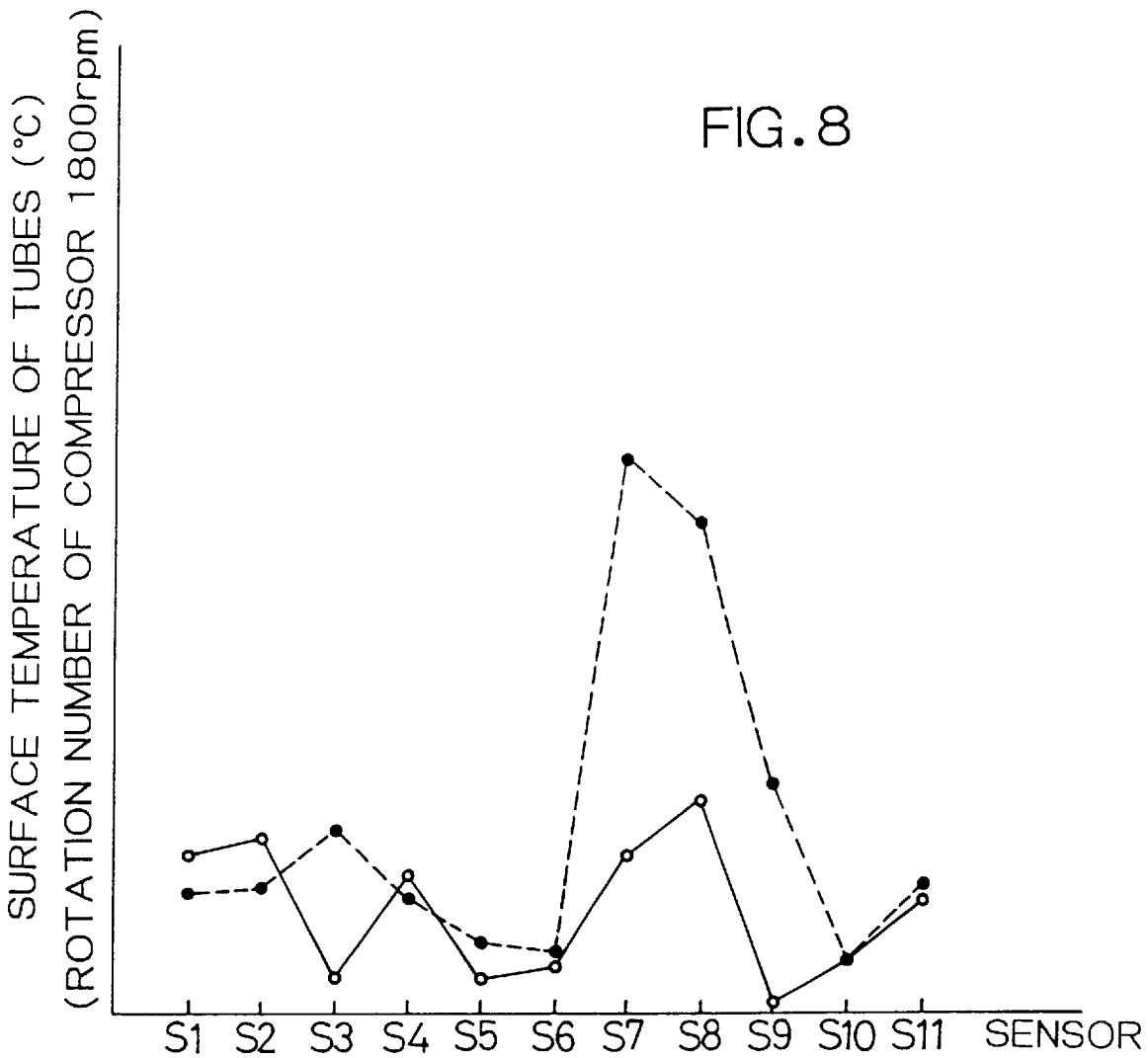
FIG. 8 is a characteristics diagram presenting the surface temperatures at the tube elements measured with the compressor rotation rate at 1800 rpm in the heat exchanger above and a heat exchanger in the prior art respectively indicated by the solid line and the broken line.

A comparison of the two characteristics diagrams presenting the results of the measurement in FIGS. 7 and 8 achieved through the temperature sensors S1 through S11 clearly indicates that while there is a slight inconsistency in the distribution of the surface temperatures in the new type of tube elements, relative consistency is achieved and the difference between the maximum temperature and the minimum temperature is also reduced compared to the distribution of surface temperatures in the old type of tube elements, in which the temperature becomes extremely high, for instance, at the temperature sensor S7.

Figure 9:
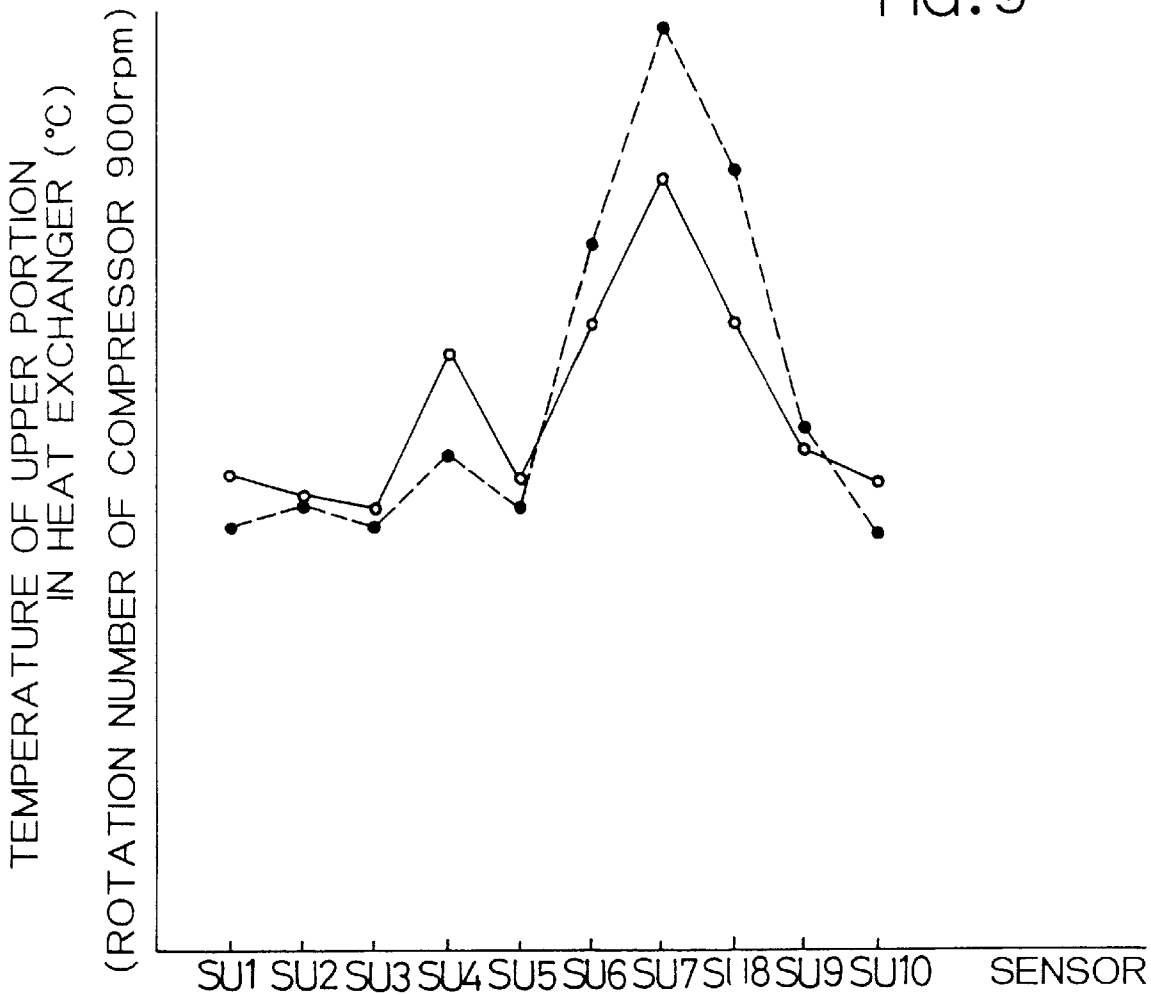
FIG. 9 is a characteristics diagram presenting the upper section temperatures measured with the compressor rotation rate at 900 rpm in the heat exchanger above and a heat exchanger in the prior art respectively indicated by the solid line and the broken line.

The characteristics diagram presented in FIG. 9 indicates the distribution of upper section surface temperatures at a laminated heat exchanger employing the new type of tube elements with the solid line and indicates the distribution of upper section temperatures at a laminated heat exchanger employing the old type of tube elements. The temperatures were measured with the rotation rate of the compressor set at 900 rpm and the air quantity for the laminated heat exchanger set at 420m$^3$ per hour. In addition, the characteristics diagram presented in FIG. 10 indicates the distribution of upper section surface temperatures at a laminated heat exchanger employing the new type of tube element with the solid line and indicates the distribution of upper section temperatures at a laminated heat exchanger employing the old type of tube elements. The temperatures were measured with the rotation rate of the compressor set at 1800 rpm and the air quantity for the laminated heat exchanger set at 420m$^3$ per hour.

The upper section temperatures at these laminated heat exchangers employing the new type of tube elements and the old type of tube elements were measured with 10 temperature sensors SU1 through SU10 provided at positions approximately 40 mm down from the end having the projecting pieces 13 and approximately 10 mm away from the fins 2 in the direction of the airflow. The specific positions of these temperature sensors are explained in reference to FIG. 1. The temperature sensor SU1 is provided between the tube element 3*b* and the second tube element 3 counting from the tube element 3*b*, the temperature sensor SU2 is provided between the third tube element 3 counting from the tube element 3*b* and the fourth tube element 3 counting from the tube element 3*b*, the temperature sensor SU3 is provided between the fifth tube element 3 counting from the tube element 3*b* and the sixth tube element 3*a* counting from the tube element 3*b*, the temperature sensor SU4 is provided between the seventh tube element 3 counting from the tube element 3*b* and the eighth tube element 3 counting from the tube element 3*b*, the temperature sensor SU5 is provided between the ninth tube element 3 counting from the tube element 3*b* and the tenth tube element 3 counting from the tube element 3*b*, the temperature sensor SU6 is provided between the eleventh tube element 3 counting from the tube element 3*b* and the twelfth tube element 3 counting from the tube element 3*b*, the temperature sensor SU7 is provided between the ninth tube element 3 counting from the tube element 3*c* and the eighth tube element 3 counting from the tube element 3*c*, the temperature sensor SU8 is provided between the seventh tube element 3 counting from the tube element 3*c* and the sixth tube element 3 counting from the tube element 3*c*, the temperature sensor SU9 is provided between the fifth tube element 3 counting from the tube element 3*c* and the forth tube element 3 counting from the tube element 3*c*, and the temperature sensor SU10 is provided between the third tube element 3 counting from the tube element 3*c* and the second tube element 3 counting from the tube element 3*c*.

Figure 10:
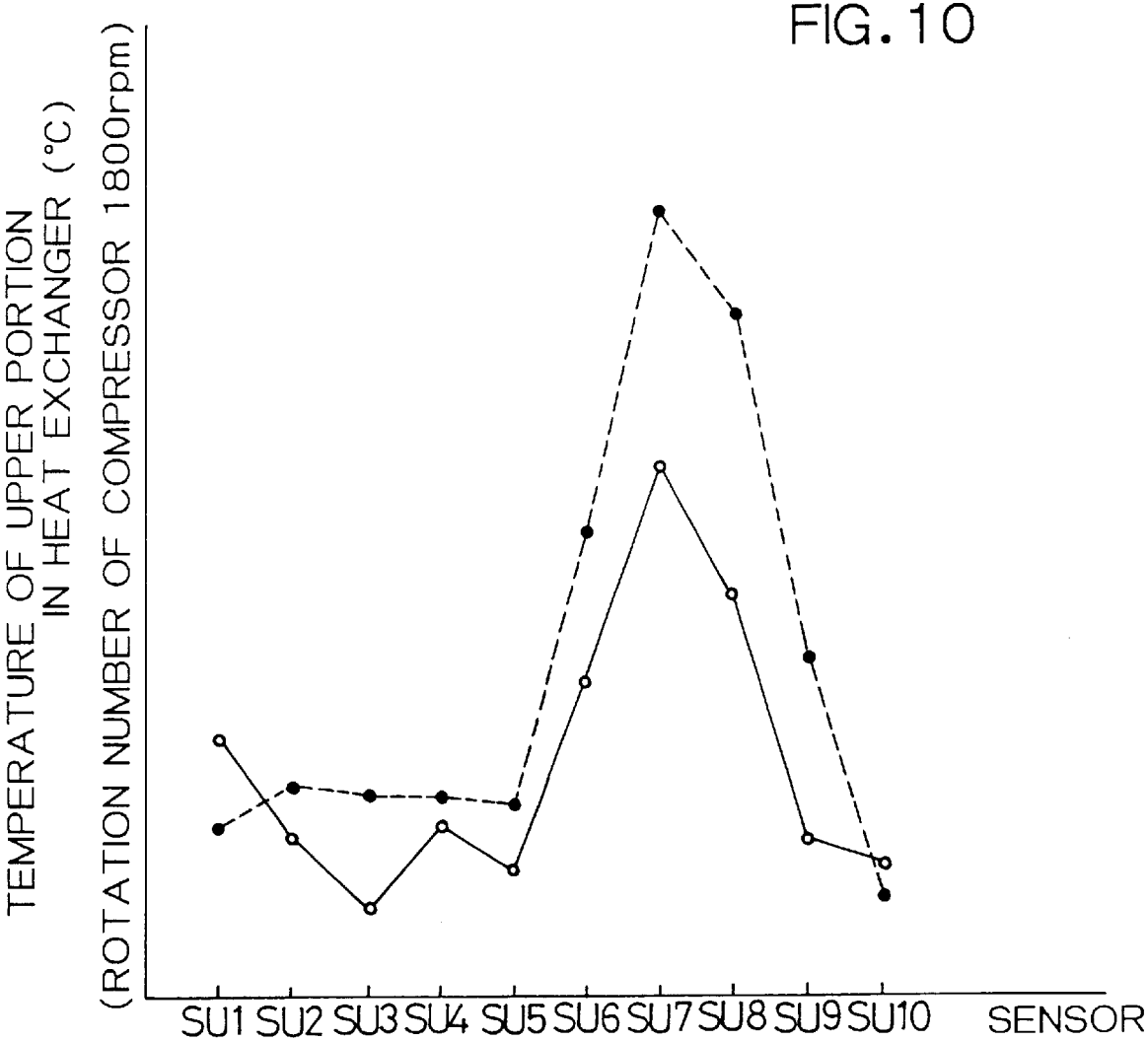
FIG. 10 is a characteristics diagram presenting the upper section temperatures measured with the compressor rotation rate at 1800 rpm in the heat exchanger above and a heat exchanger in the prior art respectively indicated by the solid line and the broken line.

A comparison of the two characteristics diagrams presenting the results of the measurement in FIGS. 9 and 10 achieved through the temperature sensors SU1 through SU10 clearly indicates that while there is a slight inconsistency in the distribution of the upper section surface temperatures in a laminated heat exchanger employing the new type of tube elements, relative consistency is achieved and the difference between the maximum temperature and the minimum temperature is also reduced compared to the distribution of upper section temperatures in a laminated heat exchanger employing the old type of tube elements in which the temperature becomes extremely high, for instance, at the temperature sensor SU7.

Figure 11:
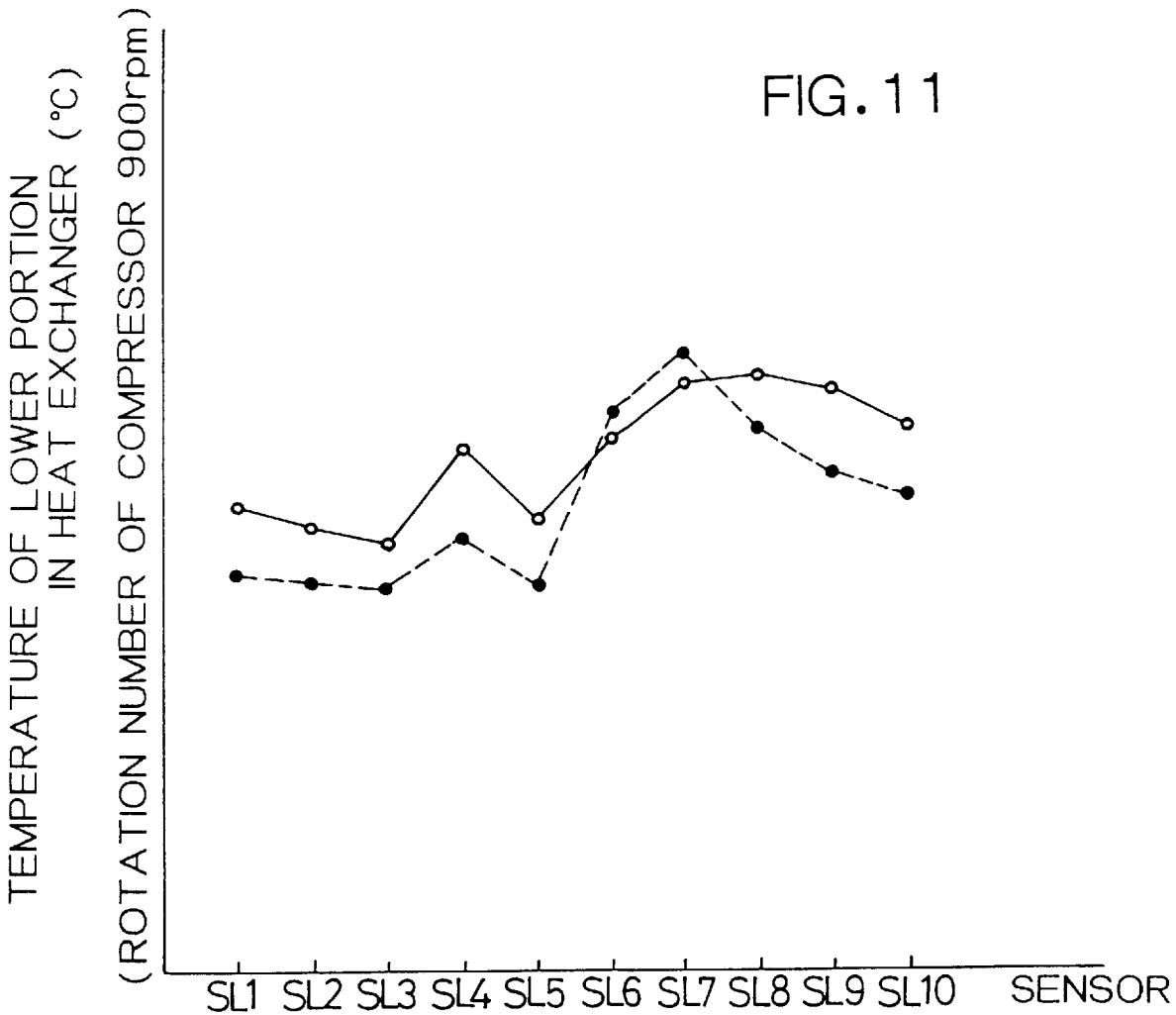
FIG. 11 is a characteristics diagram presenting the lower section temperatures measured with the compressor rotation rate at 900 rpm in the heat exchanger above and a heat exchanger in the prior art respectively indicated by the solid line and the broken line.

The characteristics diagram presented in FIG. 11 indicates the distribution of lower section temperatures at a laminated heat exchanger employing the new type of tube elements with the solid line and indicates the distribution of lower section temperatures at a laminated heat exchanger employing the old type of tube elements with the broken line. The temperatures were measured with the rotation rate of the compressor set at 900 rpm and the air quantity for the laminated heat exchanger set at 420m$^3$ per hour. In addition, the characteristics diagram presented in FIG. 12 indicates the distribution of lower section temperatures at a laminated heat exchanger employing the new type of tube element with the solid line and indicates the distribution of lower section temperatures at a laminated heat exchanger employing the old type of tube elements with the broken line. The temperatures were measured with the rotation rate of the compressor set at 1800 rpm and the air quantity for the laminated heat exchanger set at 420m$^3$ per hour.

The lower section temperatures in these laminated heat exchangers were measured with 10 temperature sensors SL1 through SL10 provided at positions approximately 30 mm above the end having the tanks 7 and approximately 10 mm the fins 2 in the direction of the airflow. It is to be noted that the explanation of the specific positions of these temperature sensors among the tube elements is omitted since their positions are identical to those of the temperature sensors SU1 through SU10 for the upper section temperature measurement described above except for that the lower section temperature sensors are positioned toward the tanks.

Figure 12:
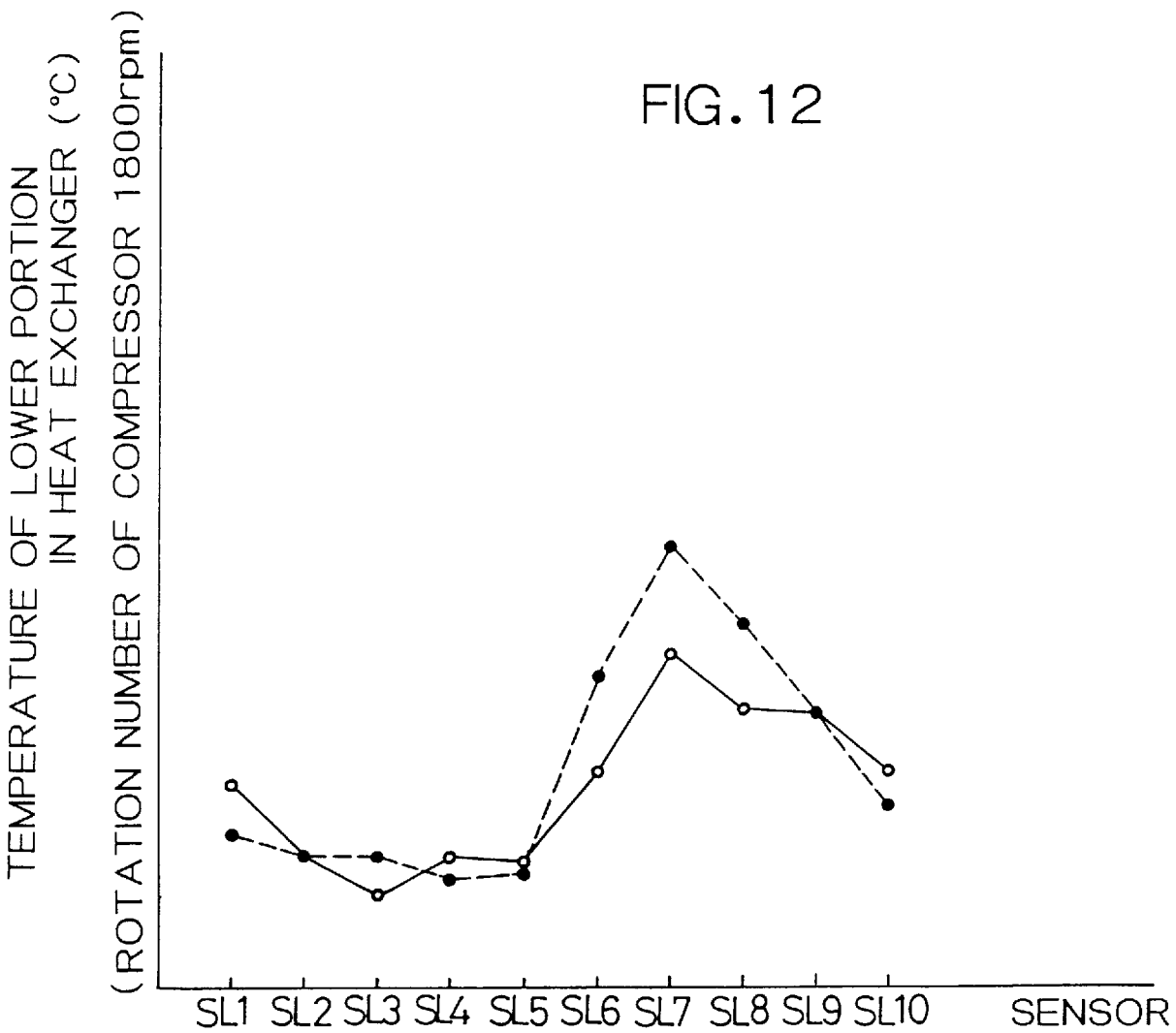
FIG. 12 is a characteristics diagram presenting the lower section temperatures measured with the compressor rotation rate at 1800 rpm in the heat exchanger above and a heat exchanger in the prior art respectively indicated by the solid line and the broken line.
Figure 13:
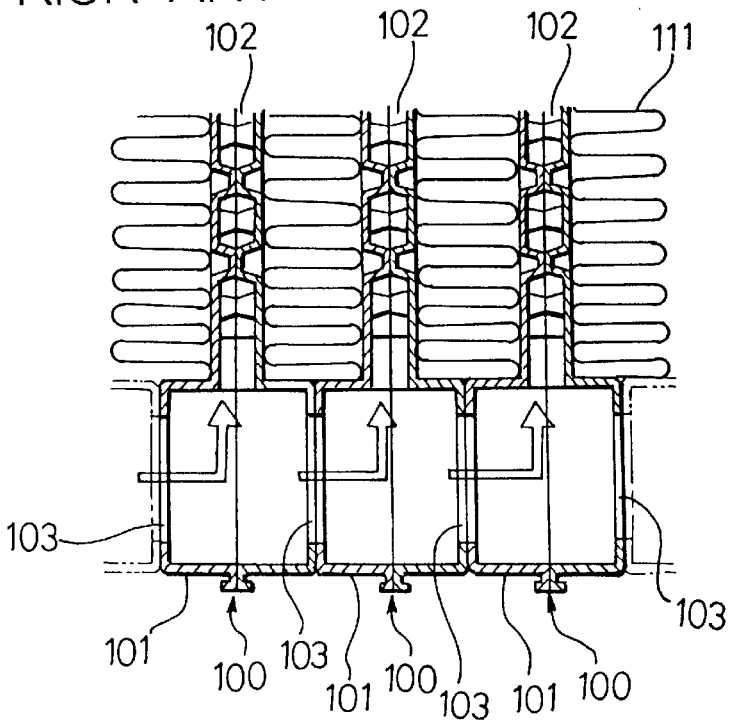
FIG. 13 PRIOR ART
FIG. 13 is a cross section illustrating a state in which the heat exchanging medium flows into heat exchanging medium passages from tanks in a heat exchanger in the prior art.
Figure 14:
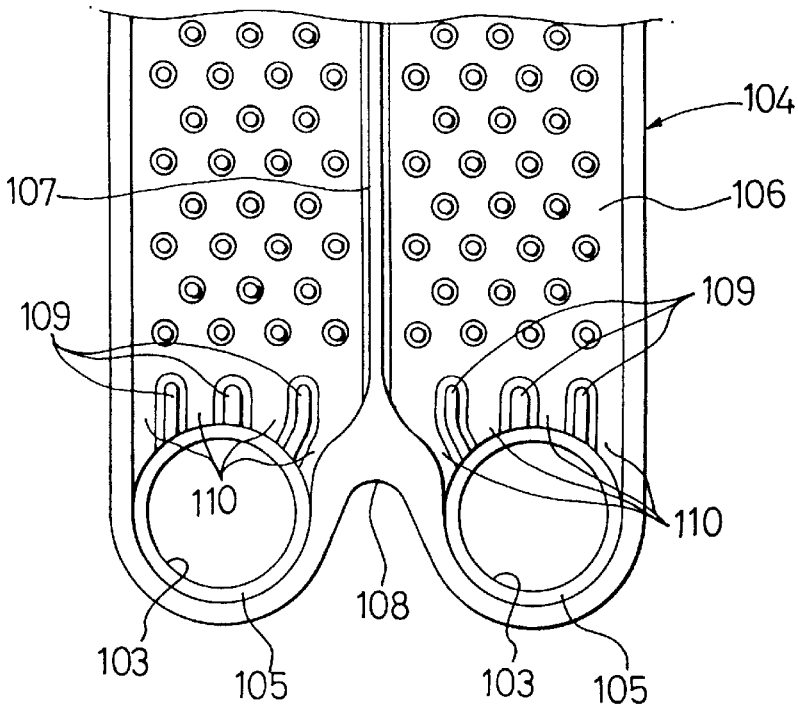
FIG. 14 PRIOR ART
FIG. 14 is a front view illustrating one of the formed plates constituting the majority of the tube elements that constitute the heat exchanger in the prior art.

By comparing the two characteristics diagrams presenting the results of the measurement performed by the temperature sensors SL1 through SL10 in FIGS. 11 and 12, it is learned that the distribution of the lower section temperatures in the laminated heat exchanger employing the new type of tube element shifts between the maximum temperature and the minimum temperature among the lower section temperatures of the laminated heat exchanger employing the old type tube elements.

Thus, it is understood that the results of the measurement of the tube element surface temperatures, the over head temperatures of the laminated heat exchanger and the lower section temperatures of the laminated heat exchanger all substantiate that the laminated heat exchanger according to the present invention achieves a higher degree of consistency in the heat exchange distribution compared to the laminated heat exchanger in the prior art.

It is to be noted that since the resistance that the heat exchanging medium is subject to when it flows from the tanks into the heat exchanging medium passages is particularly great in the tube elements that constitute the tank group in which the heat exchanging medium flows at a high speed in the direction of the lamination by traveling through the adjacent tanks via the communicating holes 25, tube elements 3 each constituted by bonding face-to-face formed plates 6 may be only employed in the area of the tank group where the heat exchanging medium flows at high speed with the remaining tube elements left not inclined, similar to those given in the example of the prior art. This structure, too, will achieve advantages almost similar to those achieved in a structure constituted with the tube elements 3 throughout the entire heat exchanger.

In addition, the present invention may be adopted in a laminated heat exchanger in which the inflow and outflow portions are provided in the direction of the airflow, and in a bilateral tank type laminated heat exchanger, provided with tanks at both sides of the tube elements, as well as in a laminated heat exchanger having its inflow and outflow portions 4 and 5 at one side in the direction of the lamination.

As has been explained, according to the present invention, since the resistance that the heat exchanging medium is subject to when it flows from the tanks into the heat exchanging medium passages is reduced by increasing the flow areas in the heat exchanging medium passages where they come into communication with the tanks and by making the inflow angle at which the heat exchanging medium changes the direction of its flow from the direction of the lamination in which it flows through the tank groups to flow into the heat exchanging medium passages at a wider angle, the heat exchanging medium can flow more smoothly and readily from the tanks into the heat exchanging medium passages, thereby achieving a more consistent distribution of the heat exchanging medium to improve the performance of the heat exchanger.

What is claimed is:

1. A laminated heat exchanger constituted at least by laminating fins and tube elements alternately over a plurality of levels;

with said tube elements each having a pair of tanks provided at one end, a projection extending out from said one end toward the vicinity of another end and a U-shaped heat exchanging medium passage communicating between said tanks which is formed around said projection, wherein:

a plurality of shoal-like beads extending along the direction in which heat exchanging medium flows are provided in portions of said heat exchanging medium passage at the boundaries between said heat exchanging medium passages and said tanks; and in said portions of said heat exchanging medium passage where said shoal-like beads are formed in at least one of said tube elements, the flow area for said heat exchanging medium gradually increases from the upper ends of said shoal-like beads toward said tanks.

2. A laminated heat exchanger according to claim 1, wherein:

tube elements each provided at a side in the direction of lamination among said tube elements are each constituted by bonding a formed plate and a flat plate; and tube elements other than said tube elements provided at two sides in said direction of the lamination are each constituted by bonding face-to-face two formed plates.

3. A laminated heat exchanger according to claim 2, wherein:

formed plates constituting at least said one tube element are each provided with distended portions for tank formation to constitute tanks and a distended portion for passage formation to constitute a heat exchanging medium passage; and wall surfaces corresponding to positions where said shoal-like beads are formed in said distended portion for passage formation incline to gradually widen outward from said upper ends of said shoal-like beads toward said tanks.

4. A laminated heat exchanger according to claim 3, wherein:

adjacent tanks in said tube elements are fluidly connected via communicating holes formed at said tanks, through which said heat exchanging medium flows in and out to form a first tank group and a second tank group extending in said direction of the lamination;

said first tank group is divided into two tank blocks, and said second tank group directly constitutes a tank block with all tanks therein in communication;

an inflow portion and an outflow portion for said heat exchanging medium are provided at one of said outermost tube elements each constituted by bonding a formed plate and a flat plate in said direction of the lamination;

said inflow portion for said heat exchanging medium communicates with tanks constituting a tank block in said first tank group furthest from said inflow portion via a communicating pipe; and said outflow portion for said heat exchanging medium communicates with tanks of said adjacent tube elements in said first tank group.

5. A laminated heat exchanger according to claim 1, wherein:

in all of said tube elements, said flow area for said heat exchanging medium gradually increases in said portions of said heat exchanging medium passage where said shoal-like beads are formed from upper ends of said shoal-like beads toward said tanks.

6. A laminated heat exchanger: constituted at least by laminating fins and tube elements alternately over a plurality of levels;

with said tube elements each having a pair of tanks provided at one end, a projection extending out from said one end toward the vicinity of another end and a U-shaped heat exchanging medium passage communicating between said tanks, which is formed around said projection, wherein;

adjacent tanks in said tube elements are fluidly connected via communicating holes formed at said tanks, through which said heat exchanging medium flows in and out to form a first tank group and a second tank group extending in the direction of lamination;

said first tank group is divided into two tank blocks, and said second tank group directly constitutes a tank block with all tanks therein in communication;

an inflow portion and an outflow portion for said heat exchanging medium are provided further outside of one of tube elements located at the outsides in said direction of the lamination;

said inflow portion for said heat exchanging medium communicates with tanks in a tank block with further away from said inflow portion via a communicating pipe;

said outflow portion for said heat exchanging medium communicates with tanks of said adjacent tube elements in said first tank group;

a plurality of shoal-like beads extending along the direction in which heat exchanging medium flows are provided in portions of said heat exchanging medium passage at the boundaries between said heat exchanging medium passages and said tanks; and in said portions of said heat exchanging medium passage where said shoal-like beads are formed in at least one of said tube elements, the flow area for said heat exchanging medium gradually increases from upper ends of said shoal-like beads toward said tanks.

7. A laminated heat exchanger according to claim 6, wherein:

tube elements each provided at a side in the direction of lamination among said tube elements are each constituted by bonding a formed plate and a flat plate; and tube elements other than said tube elements provided at two sides in said direction of the lamination are each constituted by bonding face-to-face two formed plates.

8. A laminated heat exchanger according to claim 7, wherein:

formed plates constituting at least said one tube element are each provided with distended portions for tank formation to constitute tanks and a distended portion for passage formation to constitute a heat exchanging medium passage; and wall surfaces corresponding to positions where said shoal-like beads are formed in said distended portion for passage formation incline to gradually widen outward from said upper ends of said shoal-like beads toward said tanks.

9. A laminated heat exchanger according to claim 6, wherein:

in all of said tube elements, said flow area for said heat exchanging medium gradually increases in said portions of said heat exchanging medium passage where said shoal-like beads are formed from upper ends of said shoal-like beads toward said tanks.

* * * * *